US008058994B2

(12) United States Patent
Aguirre et al.

(10) Patent No.: US 8,058,994 B2
(45) Date of Patent: Nov. 15, 2011

(54) EAS SYSTEM PROVIDING SYNCHRONIZED TRANSMISSION

(75) Inventors: Gerardo Aguirre, Pompano Beach, FL (US); Douglas A. Drew, Pompano Beach, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 654 days.

(21) Appl. No.: 11/991,689

(22) PCT Filed: Sep. 9, 2005

(86) PCT No.: PCT/US2005/032329
§ 371 (c)(1), (2), (4) Date: Mar. 8, 2008

(87) PCT Pub. No.: WO2007/032756
PCT Pub. Date: Mar. 22, 2007

(65) Prior Publication Data
US 2009/0051534 A1 Feb. 26, 2009

(51) Int. Cl.
*G08B 13/14* (2006.01)

(52) U.S. Cl. ..... 340/572.1; 340/572.4; 340/10.1; 340/10.4

(58) Field of Classification Search ..... 340/572.1
See application file for complete search history.

(56) References Cited

U.S. PATENT DOCUMENTS 4,807,259 A * 2/1989 Yamanaka et al. ..... 375/358
4,860,001 A * 8/1989 Yamanaka et al. ..... 340/825.2
4,982,185 A * 1/1991 Holmberg et al. ..... 340/825.21
5,276,659 A * 1/1994 Kotaki ..... 368/10
6,271,756 B1 * 8/2001 Davies et al. ..... 340/572.7
6,320,507 B1 * 11/2001 Strzelec et al. ..... 340/572.1

* cited by examiner

*Primary Examiner* — Benjamin C Lee
*Assistant Examiner* — Curtis King
(74) *Attorney, Agent, or Firm* — Alan M. Weisberg; Christopher & Weisberg, P.A.

(57) ABSTRACT

A system and method for providing synchronized transmission in an electronic article surveillance (EAS) system is provided. The method includes determining a transmission timing difference between a plurality of units of the EAS system using a communication link of the EAS system and synchronizing transmissions for each of the plurality of units based on the transmission timing difference.

17 Claims, 6 Drawing Sheets

EAS SYSTEM PROVIDING SYNCHRONIZED TRANSMISSION

BACKGROUND OF THE INVENTION

1. Field of the Invention

This invention relates generally to electronic article surveillance (EAS) systems and, more particularly, to a system and method for synchronizing transmissions in an EAS system.

2. Description of the Related Art

In acoustomagnetic or magnetomechanical electronic article surveillance (EAS) systems, both detection and deactivation units may be provided. Both units typically excite an EAS tag by transmitting an electromagnetic burst at a resonance frequency of the tag. When the tag is present within the electromagnetic field created by the transmission burst, and has not been deactivated, the tag begins to resonate with an acoustomagnetic or magnetomechanical response frequency that is detectable by a receiver in both detection units. The detection unit may then provide some type of signal, for example, an alarm signal indicating the detection of a response from an EAS tag. The deactivation units also typically transmit a deactivation signal to deactivate the EAS tag such that the EAS tag will not resonate with an acoustomagnetic, magnetomechanical or electromagnetic response frequency when the EAS tag is present in the electromagnetic field of the detection units.

In EAS systems, the transmitter burst signal typically does not end abruptly, but instead decays exponentially because of transmitter circuit resonance. If the transmissions from nearby units are not synchronized, false detections may occur because all units transmit and receive at the same frequency. These false detections can result in false alarms and/or false deactivations.

In order to synchronize the transmissions from the detection and deactivation units of the EAS system, a manual synchronization process is typically performed. Specifically, field service personnel use, in connection with a configuration program, phasing tools that include two loop antennae and an oscilloscope to synchronize each of the units. The synchronization is provided by changing a delay time for the unit to transmit referenced from the AC zero-crossing point of the unit. This procedure is repeated for every deactivation and detection unit, for example, in a retail store.

However, because the wiring of the AC power supply to each of the units may be different, for example, the phase may be shifted by 120 degrees depending on how the power supply is wired (e.g., how the power outlet is wired), the AC zero-crossings can be different. This can result in improper synchronization of the units because the zero-crossings are out of phase. Further, isolation transformers for each unit can also affect the required delay for synchronization with the other units. Thus, the manual synchronization process is not only time consuming and susceptible to human error, for example, in reading the oscilloscope, but the reference for synchronizing the units may be different because of wiring differences in the power supply. Out of phase synchronization can thereby result.

Other known systems or processes for synchronizing the units within the EAS system provide for communicating the exact time of transmission for each of the units or use a reference signal transmitted by a broadcast transmitter to synchronize the units. However, because of internal delays within the units and other transmission delays, these processes often fail to adequately synchronize the units and are costly to implement. Further, a reliable twenty-four hour per day reception of signals from a selected FM or TV broadcast station is needed for providing a reference signal from a broadcast transmitter. This adds complexity and cost to the system.

Units within an EAS system also may be synchronized by periodically shutting down transmissions and then listening for other EAS transmitters from which a delay between the received signals and a AC zero-crossing of the shut down unit is determined. However, this process may not satisfactorily synchronize deactivator and detector units because of the large difference in transmit power and antenna size for these different types of units.

BRIEF DESCRIPTION OF THE INVENTION

In one embodiment, a method for synchronizing transmissions in an electronic article surveillance (EAS) system is provided. The method may include determining a transmission timing difference between a plurality of units of the EAS system using a communication link of the EAS system and synchronizing transmissions for each of the plurality of units based on the transmission timing difference.

In another embodiment, a method for calibrating an electronic article surveillance (EAS) system to synchronize transmissions is provided. The method may include selecting one of a plurality of units of the EAS system as a master synchronizing unit and communicating a broadcast signal to the plurality of units upon a synchronizing event of the master synchronizing unit. The method may further include determining for each of the plurality of units a time period from receiving the broadcast signal to a next transmission of the unit and determining a difference between the time period for the master synchronizing unit and each of the other units. The method may also include establishing a delay for each of the units based on the determined difference to synchronize transmissions for each of the units.

In yet another embodiment, an electronic article surveillance (EAS) system is provided that may include at least one of a plurality of detector units and a plurality of deactivator units connected via a communication link. The EAS system may further include a system controller configured to (i) determine a transmission timing difference between the plurality of units using the communication link and (ii) synchronize transmissions for each of the plurality of units based on the transmission timing difference.

BRIEF DESCRIPTION OF THE DRAWINGS

For a better understanding of various embodiments of the invention, reference should be made to the following detailed description which should be read in conjunction with the following figures wherein like numerals represent like parts.

DETAILED DESCRIPTION OF THE INVENTION

Various embodiments of the present invention provide methods and systems for synchronizing transmissions in an electronic article surveillance (EAS) system. A typical EAS system will first be described followed by various embodiments of the invention for controlling and configuring the EAS system, and more particularly, synchronizing transmissions in the EAS system.

Figure 1:
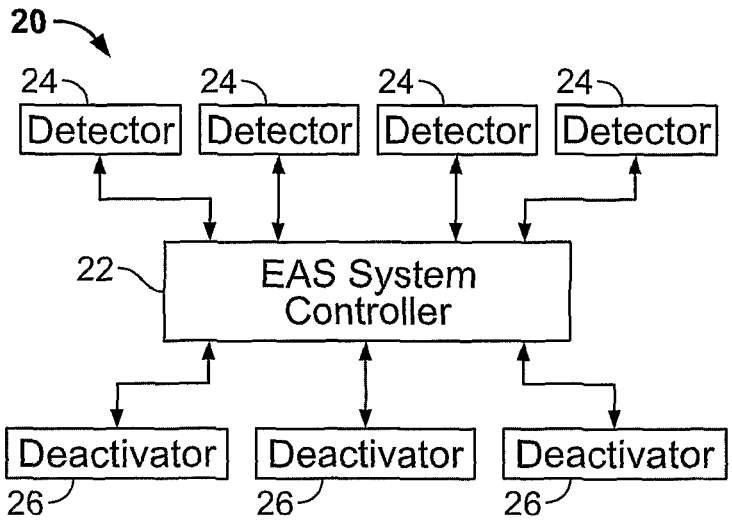
FIG. 1 is a block diagram of an embodiment of an electronic article surveillance (EAS) system in connection with which various embodiments of the invention may be implemented.

An embodiment of an EAS system 20 is shown in FIG. 1. The EAS system 10 may include an EAS system controller 22 connected to a plurality of detector units 24 and a plurality of deactivator units 26. The EAS system controller 22 controls the transmissions and receptions from the detector units 24 and deactivator units 26. The communication between the EAS system controller 22 and detector units 24 and deactivator units 26 may be provided by any suitable communication link, which in one embodiment, is a serial communication link.

The EAS system controller 22 controls transmissions from the detector units 24 and receptions received by the detector units 24 as is known to detect EAS tags within a certain range of the detector units 24. The EAS system controller also controls transmissions from the deactivator units 26 and receptions received by the deactivator units 26 as is known to deactivate EAS tags having a predetermined characteristic and that are within a certain range of the deactivator units 26.

Figure 2:
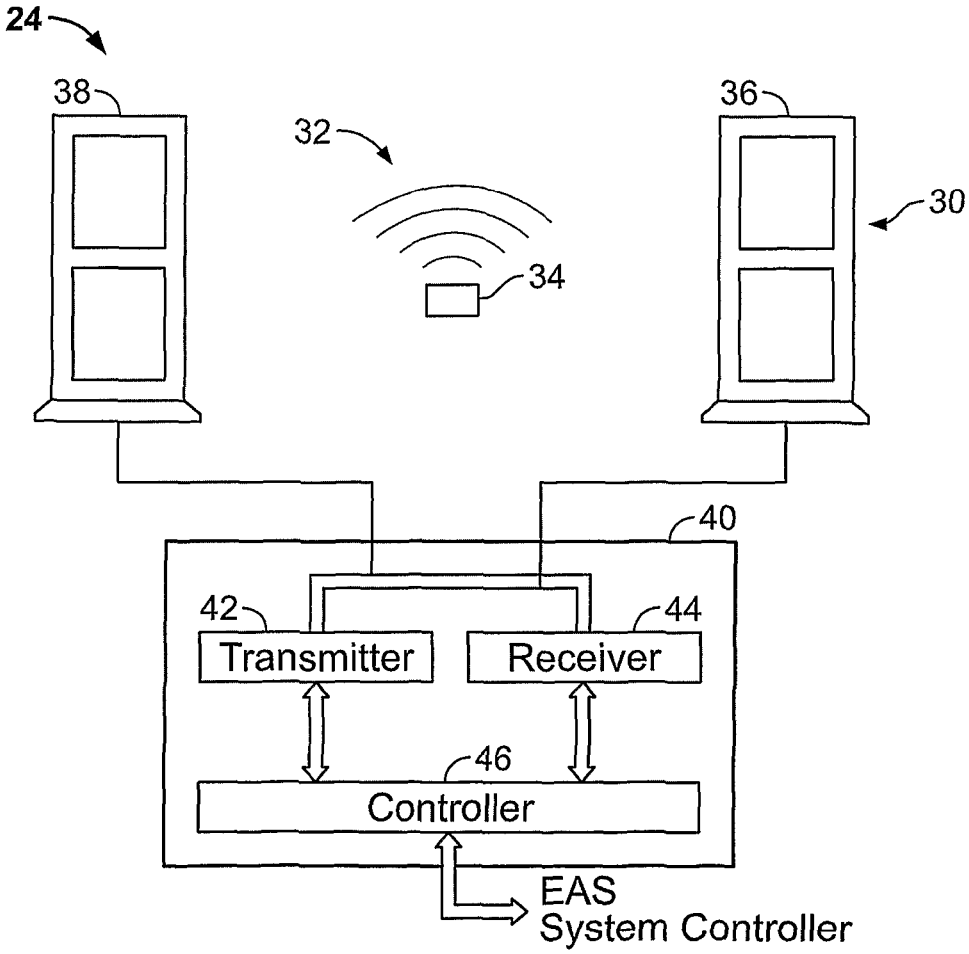
FIG. 2 is a diagram of a detector of the EAS system of FIG. 1.

The detector units 24 and deactivator units 26 may be of any type as desired or needed, for example, a SENSORMATIC® detector unit or deactivator unit available from Tyco Fire & Security of Boca Raton, Fla. As an example, FIG. 2 is an illustration of a detector unit 24 of the EAS system 10 and which may be controlled and synchronized by the various embodiments of the invention described herein. Specifically, the detector unit 24 may include a detector portion 30 defining a detection area 32 for detecting an EAS tag 34 within the detection area 32. The detector portion 30 in one embodiment includes a first antenna pedestal 36 and a second antenna pedestal 38. The antenna pedestals 36 and 38 may be connected to a control unit 40 that includes a transmitter 42 and a receiver 44. Within the control unit 40 a controller 46 configured to provide communication with an external device, for example, the EAS system controller 22 (shown in FIG. 1).

In addition, controller 46 may be configured to control transmissions from transmitter 42 and receptions at receiver 44 such that the antenna pedestals 36 and 38 can be utilized for both transmission of signals to the EAS tag 34 and reception of signals generated by the EAS tag 34. In operation, and for example, upon receiving a signal from an EAS tag 34 within the detection area 32 that has not been deactivated by the deactivator unit 26, a visual and/or audible alarm may be provided.

Detector unit 24 is representative of many detector systems and is provided as an example only. For example, in an alternative embodiment, control unit 40 may be located within one of the antenna pedestals. In still another embodiment, additional antennas that only receive frequencies from the EAS tags 34 may be utilized as part of the EAS system 20. Also, a single control unit 40, either within a pedestal or located separately, may be configured to control multiple sets of antenna pedestals.

Figure 3:
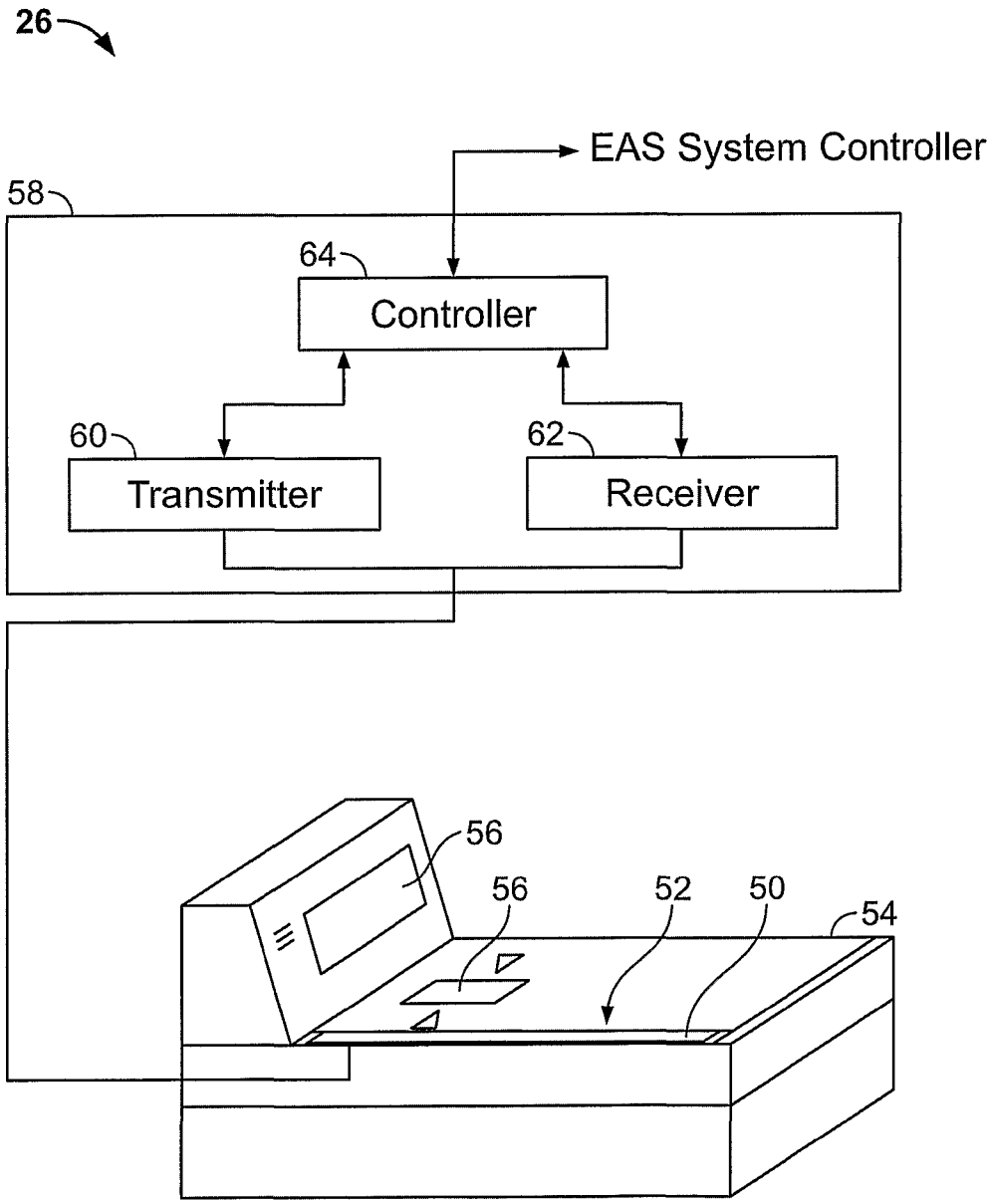
FIG. 3 is a diagram of a deactivator of the EAS system of FIG. 1.

As a further example, FIG. 3 is an illustration of a deactivator unit 26 of the EAS system 10 and which may be controlled and synchronized by the various embodiments of the invention described herein. Specifically, the deactivator unit 26 may include a deactivator portion 50 defining a deactivation area 52 for deactivating an EAS tag within the deactivation area 52. The deactivator portion 50 in one embodiment may be a separate unit configured to be connected to, for example, a barcode scanner unit 54. In an alternative embodiment, the deactivator portion 50 may be integrated with the barcode scanner unit 54. The barcode scanner unit 54 also may include scanning portions 56 for scanning items having a readable barcode. The deactivator portion 50 may be connected to a control unit 58 that includes a transmitter 60 and a receiver 62. Within the control unit 58 a controller 64 is configured to provide communication with an external device, for example, the EAS system controller 22 (shown in FIG. 1).

In addition, controller 64 may be configured to control transmissions from transmitter 60 and receptions at receiver 62 such that the deactivator portion 50, which may include one or more antennas (not shown), can be utilized for both transmission of signals to an EAS tag, for example, provided as part of an item label or package, and reception of signals generated by the EAS tag. In operation, and for example, upon receiving a signal from an EAS tag within the deactivation area 52 having a predetermined characteristic, the transmitter 60 may transmit a deactivation signal to deactivate the EAS tag as is known.

Deactivator unit 26 is representative of many deactivator systems and is provided as an example only. For example, in an alternative embodiment, control unit 58 may be located within the barcode scanner unit 54. In still another embodiment, the deactivator portion 50 may be configured having a different shape and orientation, for example, oriented transversely as opposed to longitudinally as shown in FIG. 3.

Various embodiments of the invention provide for synchronizing transmissions in an EAS system, and more particularly, synchronizing transmission from the detector units 24 and deactivator units 26. It should be noted that each of the detector units 24 and deactivator units 26 may be assigned a unique address, and more particularly, each control unit associated therewith may be assigned, for example, a unique serial number. Further, the detector units 24 and deactivator units 26 may include, for example, processors and or memory provided as part of the controllers of these units for storing information.

Figure 4:
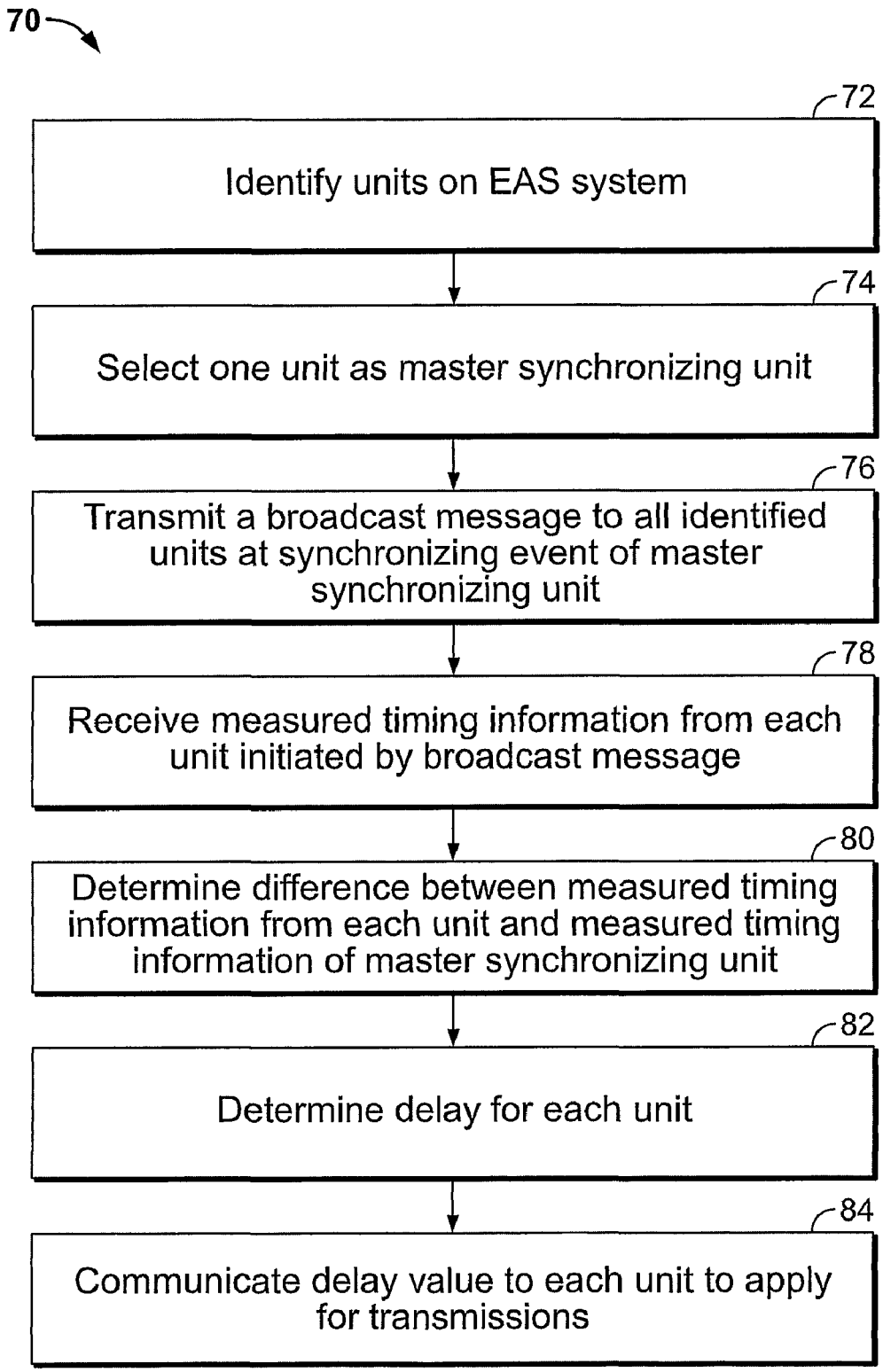
FIG. 4 is a flowchart of a method for synchronizing transmissions in an EAS system in accordance with an embodiment of the invention.

FIG. 4 is a flowchart of method 70 for synchronizing transmissions in an EAS system. Specifically, at 72, the detector units and deactivator units of the EAS system may be identified. For example, each unit may be identified by a unique address corresponding to the unit. This identification process may include accessing a database of stored addresses or polling units on a plurality of communication channels to determine the connected detector and deactivator units. For example, in a retail environment, such as a grocery store, a plurality of deactivator units may be provided at checkouts and a plurality of detection units provided at the entrances/exits of the store. Communication between the units and the controller, for example, the EAS system controller 22 (shown in FIG. 1), may be provided via serial communication links that define a network architecture. For example, network communication may be provided using a RS-232 communication link and local communication with the units may be provided using a RS-485 communication link. Thus, each of the detector and deactivator units may be provided with a unique network address that is addressable via a port, such as, for example, a RS-232 service port of the EAS system.

It should be noted that communication and configuration of the units within the network may be provided using any known communication and control program and user interface as desired or needed. For example, in one embodiment, the communication and configuration functionality may be provided via a Configurator interface available from Tyco Fire & Security of Boca Raton, Fla.

Upon identifying the units at 72, one of the plurality of detector and deactivator units may be selected as the master synchronizing unit at 74. For example, a user may select one of the identified units as the master synchronizing unit via a user interface. After selecting a master synchronizing unit, at 76 a broadcast message may be communicated to all of the identified units. The broadcast message is communicated upon a synchronizing event of the master synchronizing unit.

Figure 5:
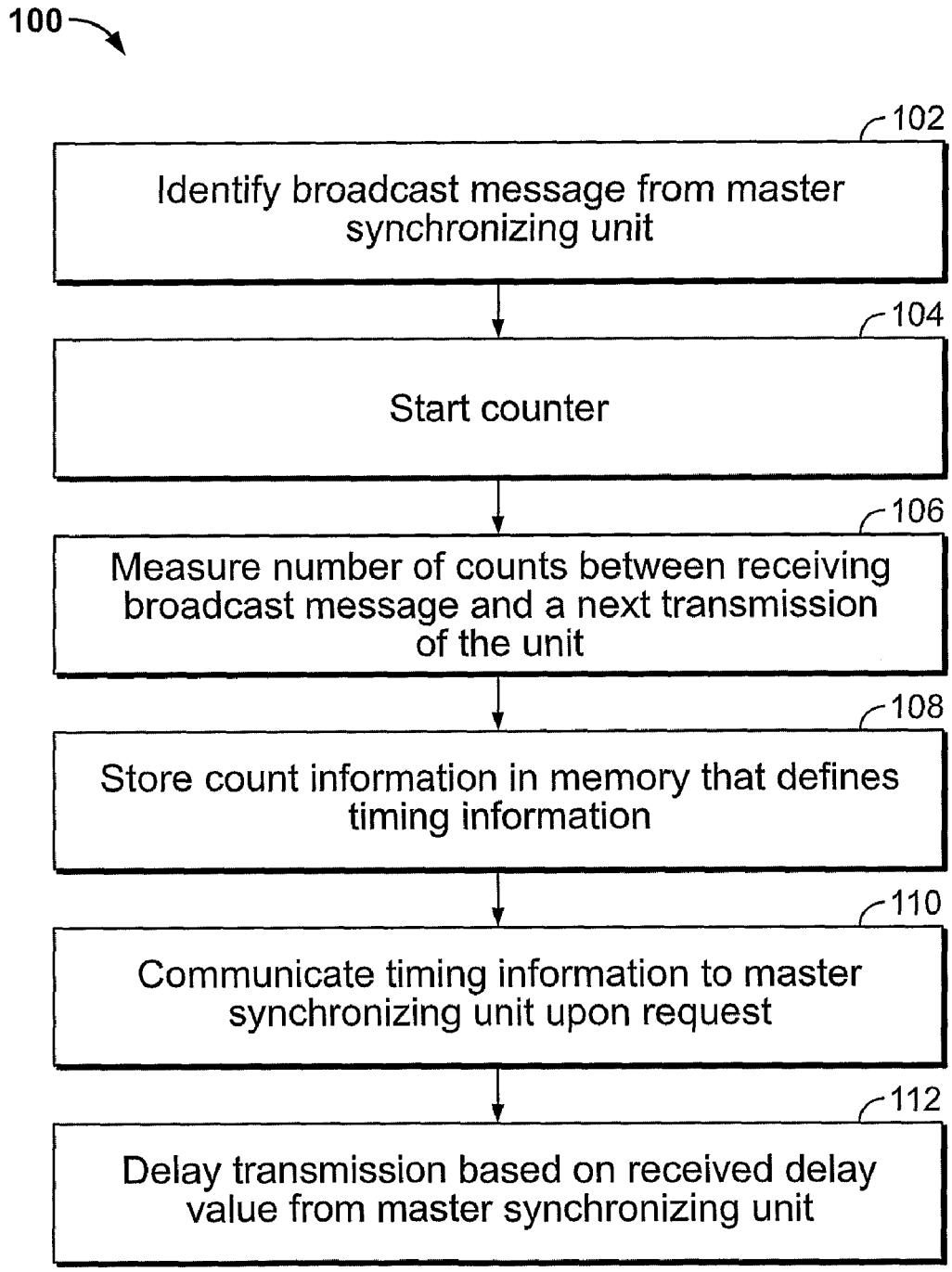
FIG. 5 is a flowchart of a unit synchronizing detection process in accordance with an embodiment of the invention.

Upon receiving the broadcast message, a unit synchronizing detection process 100 as shown in FIG. 5 may be initiated by each of the detection and deactivator units. This process 100 will be described in more detail below and results in each unit generating timing information, for example, a count value between the time the unit received the broadcast message and a next transmission of the unit. At 78, the timing information from each of the units as initiated by the broadcast message is received. The master synchronizing unit may also generate timing information. A difference between the timing information for each of the units and the timing information for the master synchronizing unit may then be determined at 80. For example, in one embodiment, this may include determining the difference in a count value for each of the units compared to the master synchronizing unit.

Based upon the difference, a delay for each of the units may be determined at 82. For example, the calculated difference value for each of the units may be converted to a delay value corresponding to the calculated difference in count values. The delay value for each of the units may then communicated to the corresponding unit at 84 to delay each transmission from that unit, for example, delayed from a master clock. Thus, each of the units may now be synchronized with respect to all of the other units, and in particular, each of the periodic transmissions from each of these units is synchronized.

It should be noted that the method 70 may be performed iteratively until a minimum timing difference between the units is achieved. This iterative process may be performed, for example, for an individual unit, until the timing difference is less than a predetermined value, for example, such that transmissions will not interfere with receptions. For example, the predetermined value may be fifty microseconds.

Referring now to FIG. 5, upon receiving the broadcast message, a unit synchronizing detection process 100 may be initiated by each of the detection and deactivator units. In particular, upon identifying a broadcast message from the master synchronizing unit at 102, a counter within the unit may be started at 104. For example, a count flag may be set independently within each of the units. It should be noted that each count of the counter represents a time period and may be the same for each of the units. In an alternative embodiment, a timer may be started. The number of counts between receiving the broadcast message and a next transmission (or zero crossing) for that unit may be measured at 106.

The count information, which defines timing information for each of the units may then be stored at 108, for example, stored within a Random Access Memory (RAM) of each of the units. The timing information, which in this embodiment is a count value, may be communicated to the master synchronizing unit at 110 upon a request therefrom. Thereafter, at 112, each unit may receive a delay value as described above for delaying transmissions of that unit based on the timing information. For example, the delay value may be communicated to the control unit of each of the detector and deactivator units for use in delaying each transmission from the transmitter of the units. It should be noted that the delay for each of the units may be different.

Figure 6:
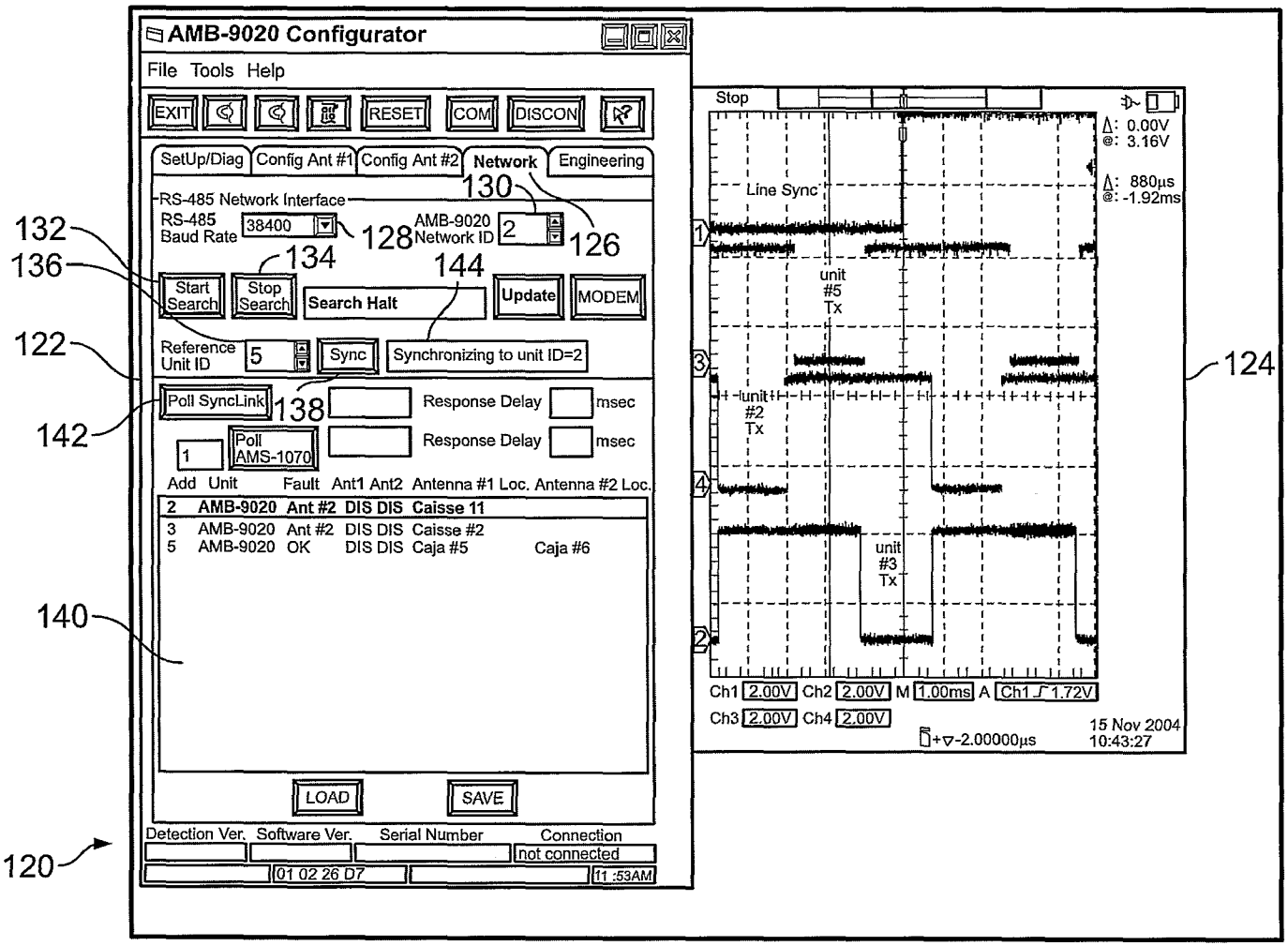
FIG. 6 is a diagram of a user interface for controlling synchronization of detector and deactivation units of an EAS system in accordance with an embodiment of the invention.
Figure 7:
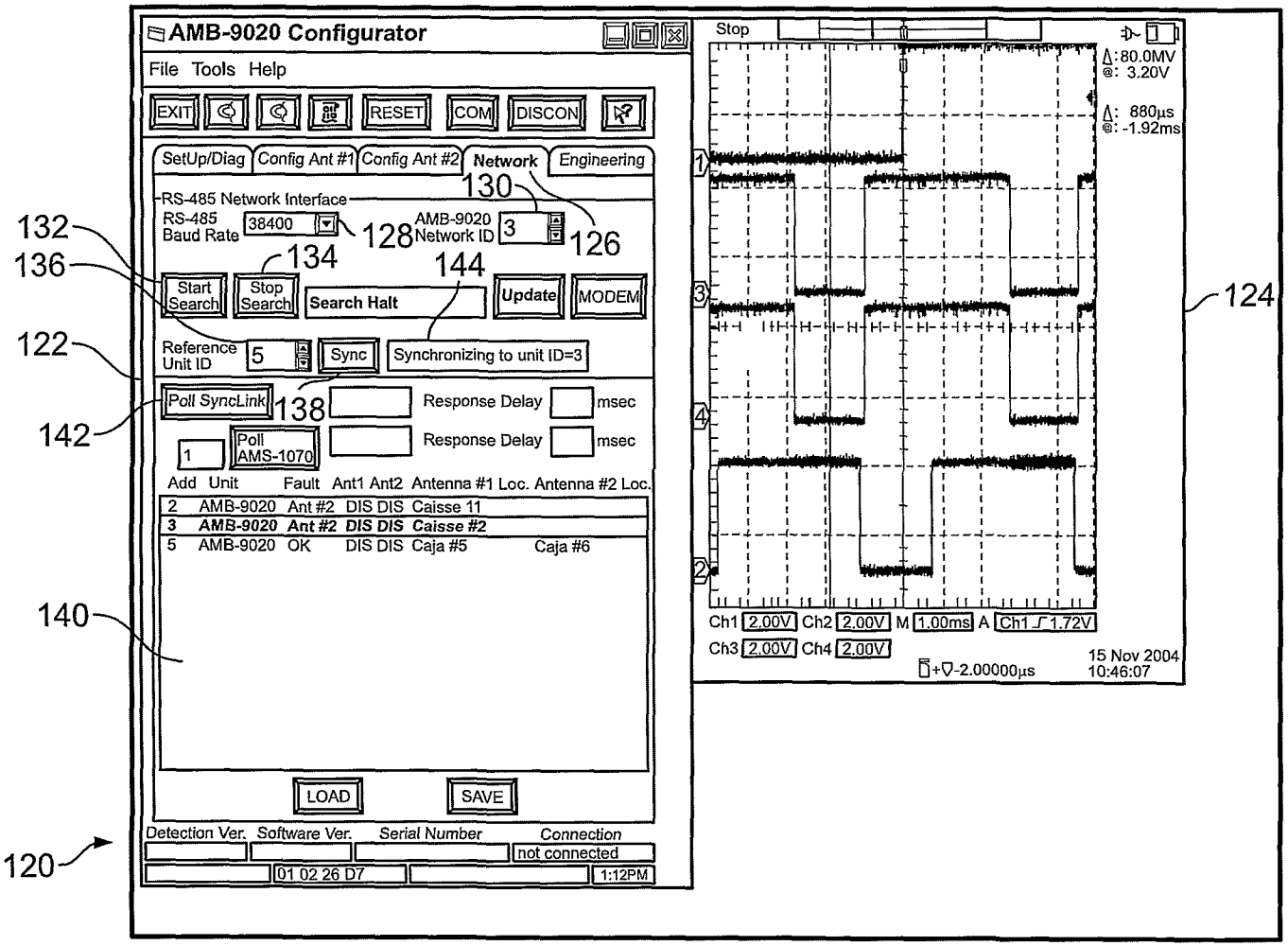
FIG. 7 is an embodiment of the user interface for controlling synchronization of detector and deactivation units of an EAS system in accordance with an embodiment of the invention after synchronizing a unit.

The various embodiments of the invention also may include a user interface for controlling the synchronization of the units of the EAS system as described herein. For example, as shown in FIGS. 6 and 7, a user interface 120 may be provided having a control portion 122 and an analysis portion 124. The control portion 122 may include a network interface control panel 126 for use in controlling the units connected to a particular EAS network and for controlling the synchronization thereof. A communication rate (e.g., baud rate) may be selected in a baud rate field 128 and a Network ID field 130 may be provided for selecting a unit of the EAS system. A user may start or stop a search, for example, for detector and deactivator units provided as part of the selected EAS network using a Start Search selection member 132 and a Stop Search selection member 134, respectively. Upon identifying the units on the EAS network, for example, using the search feature, a master synchronizing unit may be selected using the Reference Unit ID field 136. A user may also select for synchronization less than the total number of units. The identified units may be displayed in a unit identification portion 140.

The transmission timing of one or more of the selected units is displayed on the analysis portion 124, which in this embodiment, is configured as an oscilloscope. It should be noted, and as shown, the timing of transmissions of these units may not be synchronized. Upon selecting a master synchronizing unit, a synchronizing process, for example, as shown and described with reference to FIGS. 4 and 5 may be initiated. For example, by activating (e.g., depressing using a mouse) a Poll SyncLink selection member 142, a broadcast message transmission may be communicated to each of the units using the various embodiments described herein. Thereafter, upon determining the delay for each unit using the various embodiments as described herein, activating the Sync selection member 138, may synchronize the first unit in the list of units displayed in unit identification portion 140, in this example, unit 2, with the master synchronizing unit, in this example, unit 5. This includes, transmitting to that unit a delay value as described in more detail herein.

After the first unit is synchronized with the master synchronizing unit, as shown by the analysis portion 124 in FIG. 7, the synchronization process may continue with the other units in the list. For example, as shown in FIG. 7, the next unit in the list may be selected for synchronization using the Network ID field 130, in this example, unit 3. Each of the units may be communicated a delay value as described herein and a user can confirm synchronization of each of the units using the analysis portion 124. A status (for example, the unit being synchronized) may be displayed in a status display portion 144.

It should be noted that other user selectable members may be provided, for example, for exiting and resetting the user interface 120. Additionally, user selectable members for loading and storing information to and from the user interface also may be provided.

Further, the user interface 120 may be provided as part of a portable device for synchronizing the units in the EAS system. Alternatively, the user interface 120 may be provided as part of a system device that may remotely access the EAS network.

Thus, the various embodiments of the invention provide for synchronizing transmissions of detection and deactivator units in an EAS system. In particular, using a single unit as a reference, and communicating with the other units via a communication link, for example, a serial communication link, a delay for each of the units relative to the reference unit, namely the master synchronizing unit, may be determined and used to synchronize the transmission of each of the units.

The various embodiments or components, for example, the EAS system controller 22 or other controllers, may be implemented as part of a computer system, which may be separate from or integrated with an EAS system. The computer system may include a computer, an input device, a display unit and an interface, for example, for accessing the Internet. The computer may include a microprocessor. The microprocessor may be connected to a communication bus. The computer may also include a memory. The memory may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system.

As used herein, the term "computer" may include any processor-based or microprocessor-based system including systems using microcontrollers, reduced instruction set circuits (RISC), application specific integrated circuits (ASICs), logic circuits, and any other circuit or processor capable of executing the functions described herein. The above examples are not intended to limit in any way the definition and/or meaning of the term "computer".

The computer system executes a set of instructions that are stored in one or more storage elements, in order to process input data. The storage elements may also store data or other information as desired or needed. The storage element may be in the form of an information source or a physical memory element within the processing machine.

The set of instructions may include various commands that instruct the computer as a processing machine to perform specific operations such as the methods and processes of the various embodiments of the invention. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are examples only, and are thus not limiting as to the types of memory usable for storage of a computer program.

It is to be understood that variations and modifications of the various embodiments of the present invention can be made without departing from the scope thereof. It is also to be understood that the scope of the various embodiments invention is not to be interpreted as limited to the specific embodiments disclosed herein, but only in accordance with the appended claims when read in light of the forgoing disclosure.

What is claimed is:

1. A method for synchronizing transmissions of a plurality of units in an electronic article surveillance (EAS) system, said method comprising:

receiving timing information from each of the plurality of units in order to synchronize transmissions for each of the plurality of units, the plurality of units including a master unit and at least one non-master unit, the timing information of each of the plurality of units being based on a time period from receiving a broadcast message to a next interrogation/deactivation transmission of the corresponding unit to corresponding EAS tags;

determining transmission timing differences for each of the non-master units from which timing information was received, the transmission timing difference for each unit being based on the received timing information from the corresponding unit; and transmitting a delay amount for each of the non-master units based on the determined timing difference for the corresponding unit, thereby synchronizing the transmissions for each of the units based on the transmission timing difference;

wherein the transmission timing difference for each non-master unit is based on the difference in timing information between the master synchronizing unit and the corresponding non-master unit.

2. A method in accordance with claim 1 further comprising transmitting a broadcast message to the plurality of units based on a synchronizing event of the master synchronizing unit, each of the plurality of units initiating a synchronizing detection process to determine the corresponding timing information.

3. A method in accordance with claim 2 wherein the synchronizing event is one of a zero crossing and a transmission start time.

4. A method in accordance with claim 2 wherein the time period for each unit is based on a count value for each of the units, the start of the count corresponding to the receiving of the broadcast message and the end of the count corresponding to the next transmission of the corresponding unit.

5. A method in accordance with claim 1 wherein the determining is performed iteratively.

6. A method in accordance with claim 1 further comprising storing the transmission timing difference corresponding to each of the plurality of non-master units in a memory of each of the units.

7. A method in accordance with claim 1 wherein the plurality of units comprise at least one of an EAS detector unit and an EAS deactivator unit.

8. A method in accordance with claim 1 further comprising receiving a user input to select units for synchronizing.

9. A method in accordance with claim 1 further comprising providing a user interface for receiving user inputs to control the synchronizing.

10. A method in accordance with claim 1 wherein the EAS system comprises a serial network for communicating with each of the plurality of units.

11. A method for calibrating an electronic article surveillance (EAS) system to synchronize interrogation/deactivation transmissions of a plurality of units to corresponding EAS tags, said method comprising:

selecting one of the plurality of units of the EAS system as a master synchronizing unit;

transmitting a broadcast signal to the plurality of units upon a synchronizing event of the master synchronizing unit;

determining for each of the plurality of units a time period from receiving the broadcast signal to a next interrogation/deactivation transmission of the corresponding unit;

determining a difference between the time period for the master synchronizing unit and each of the non-master units, the difference based on the corresponding determined time period for each of the plurality of units;

determining a delay for each of the non-master units based on the determined difference for the corresponding unit to synchronize transmissions for each of the non-master units; and transmitting the corresponding delay to each of the non-master units.

12. A method in accordance with claim 11 further comprising starting a counter within each of the units upon receiving the broadcast signal, the counter determining the time period.

13. A method in accordance with claim 11 further comprising communicating with each of the units via a serial network.

14. A method in accordance with claim 11 wherein the units comprise EAS detector units and EAS deactivator units.

15. An electronic article surveillance (EAS) system comprising:

at least one of a plurality of detector units and at least one of a plurality of deactivator units connected via a communication link; and a system controller configured to:

(i) receive timing information from at least one of the plurality of detector units and deactivator units in order to synchronize transmissions for each of the plurality of units, the timing information of each unit based on a time period from receiving a broadcast message to a next interrogation/deactivation transmission of the corresponding unit;

(ii) determine transmission timing differences between a selected one of the plurality of units and non-selected units using the communication link, the transmission timing difference for each non-selected unit based on corresponding timing information; and (iii) transmit a delay amount for each non-selected unit based on the determined corresponding timing difference for each non-selected unit thereby synchronizing transmissions for each of the plurality of units.

16. An EAS system in accordance with claim 15 wherein each of the plurality of units is configured to measure the time period from receiving the broadcast message based on a synchronizing event of the selected unit to the next transmission of the corresponding unit, the time period determined using a counter within each of the units.

17. An EAS system in accordance with claim 15 further comprising a user interface for controlling the synchronization, and wherein the user interface comprises a control portion and an analysis portion.

* * * * *